US008013558B2

(12) United States Patent
Liebsch et al.

(10) Patent No.: US 8,013,558 B2
(45) Date of Patent: Sep. 6, 2011

(54) METHOD FOR ADJUSTING A CLOSING GAP IN A PIECE OF FURNITURE, DEVICE FOR MOVING A MOVABLE FURNITURE PART RELATIVE TO A STATIONARY FURNITURE PART, AND PIECE OF FURNITURE

(75) Inventors: Ronald Liebsch, Wangen (DE); Holger Wenzel, Lindau (DE)

(73) Assignees: Grass GmbH, Hochst (AT); Küster Automotive Door Systems GmbH, Ehringshausen (DE)

( * ) Notice: Subject to any disclaimer, the term of this patent is extended or adjusted under 35 U.S.C. 154(b) by 404 days.

(21) Appl. No.: 12/244,148

(22) Filed: Oct. 2, 2008

(65) Prior Publication Data

US 2009/0079309 A1 Mar. 26, 2009

Related U.S. Application Data

(63) Continuation of application No. PCT/EP2007/003026, filed on Apr. 4, 2007.

(30) Foreign Application Priority Data

Apr. 4, 2006 (DE) ..... 20 2006 005 581 U

(51) Int. Cl.
*G05B 5/00* (2006.01)

(52) U.S. Cl. ..... 318/468; 318/466; 318/450

(58) Field of Classification Search ..... 318/468, 318/466, 450, 646, 9, 568.13; 312/319.1, 312/319.5

See application file for complete search history.

(56) References Cited

U.S. PATENT DOCUMENTS

| | | | |
|---|---|---|---|
| 6,685,288 | B1 | 2/2004 | MacMillan |
| 2006/0261769 | A1* | 11/2006 | Rees ..... 318/450 |

FOREIGN PATENT DOCUMENTS

| | | | |
|---|---|---|---|
| AU | 007 723 | U1 | 6/2005 |
| DE | 94 10 504.9 | U1 | 11/1994 |
| DE | 101 05 756 | A1 | 8/2001 |
| DE | 203 08 256 | U1 | 6/2004 |
| DE | 20 2004 007 170 | U1 | 9/2004 |
| DE | 20 2005 013 128 | U1 | 12/2005 |
| DE | 10 2004 045 568 | A1 | 3/2006 |
| DE | 20 2005 018 353 | U1 | 3/2006 |
| DE | 10 2004 045 567 | A1 | 4/2006 |
| DE | 20 2005 006 945 | U1 | 6/2006 |
| DE | 20 2006 002 103 | U1 | 8/2006 |
| DE | 20 2006 012 976 | U1 | 12/2006 |
| DE | 20 2006 012 656 | U1 | 2/2007 |
| DE | 20 2005 021 123 | U1 | 3/2007 |
| EP | 1 323 363 | A1 | 7/2003 |
| EP | 1 323 364 | A1 | 7/2003 |

(Continued)

*Primary Examiner* — Karen Masih
(74) *Attorney, Agent, or Firm* — Burr & Brown

(57) ABSTRACT

A method for adjusting a closing gap in a piece of furniture, which comprises a device for moving a movable furniture part relative to a stationary furniture part by means of a drive unit, by means of which the furniture part can be driven to move relative to the stationary furniture part via a monitoring unit for monitoring the movement of the movable furniture part, with the closing gap being formed between a front part of the movable furniture part and the stationary furniture part when the movable furniture part is in a closed position with respect to the stationary furniture part. According to the invention, the closing gap is adjusted in an activated, electronically assisted, adjusting mode.

24 Claims, 1 Drawing Sheet

FOREIGN PATENT DOCUMENTS

| | | | |
|---|---|---|---|
| EP | 1 374 732 | A1 | 1/2004 |
| WO | 2004/100717 | A1 | 11/2004 |
| WO | 2004/100718 | A1 | 11/2004 |
| WO | 2005/058092 | A1 | 6/2005 |
| WO | 2006/029894 | A1 | 3/2006 |

* cited by examiner

METHOD FOR ADJUSTING A CLOSING GAP IN A PIECE OF FURNITURE, DEVICE FOR MOVING A MOVABLE FURNITURE PART RELATIVE TO A STATIONARY FURNITURE PART, AND PIECE OF FURNITURE

CROSS REFERENCE TO RELATED APPLICATIONS

This application is a continuation of International Application No. PCT/EP2007/003026, filed Apr. 4, 2007, which designated the United States, and claims the benefit under 35 USC §119(a)-(d) of German Application No. 20 2006 005 581.9 filed Apr. 4, 2006, the entireties of which are incorporated herein by reference.

FIELD OF THE INVENTION

The invention relates to a method for adjusting a closing gap in a piece of furniture, a device for moving a movable furniture part relative to a stationary furniture part, and a piece of furniture.

BACKGROUND OF THE INVENTION

In the field of furniture, devices are known which allow a driven movement of a movable furniture part relative to a stationary furniture part by means of a monitoring unit and a drive unit. This also relates to arrangements in which, when the movable furniture part is in a closed position with respect to the stationary furniture part, a closing gap can be formed between part of the movable furniture part and the stationary furniture part. It is frequently desirable to be able to adjust this closing gap. The gap width, shape and the profile of the closing gap are influenced via the sections, which are positioned relative to one another, of the relevant furniture parts when the movable furniture part is in the closed position. The actual configuration of the closing gap may therefore depend in particular on manufacturing tolerances of the parts used to construct the piece of furniture, and/or may depend on discrepancies from ideal fitting positions, and may thus be subject to a variation range. In addition, the use of the furniture parts during their life can lead to changes of sections, for example by material wear, which can likewise influence the configuration of the closing gap. Closing gap adaptation is therefore required, at least from time to time.

In addition, even in those situations in which a closing gap under consideration does not itself have any discrepancy, or possibly only has a very minor discrepancy, from an originally desired closing gap, adjustment or correction of the closing gap may be desirable for example in order to allow the closing gap to be matched to adjacent sections. This is of particular interest in the case of a plurality of movable furniture parts which represent a unit and are intended to produce a strictly uniform visual impression when viewed together of all the movable furniture parts in the closed state, in particular in order to allow a viewing surface without any disturbances to be created, as is desirable, for example, for esthetic reasons. However, this can be achieved only when all the closed front parts of the plurality of furniture parts are exactly aligned with one another, and this can be achieved only when the closing gaps are set up appropriately.

SUMMARY OF THE INVENTION

The object of the invention is to allow a closing gap between a driven movable furniture part and a stationary furniture part to be adjusted comparatively exactly and easily when the movable furniture part is in the closed final position.

The invention is first of all based on a method for adjusting a closing gap in a piece of furniture which comprises a device for moving a movable furniture part relative to a stationary furniture part by means of a drive unit, by means of which the furniture part can be driven to move relative to the stationary furniture part via a monitoring unit for monitoring the movement of the movable furniture part, the closing gap being formed between a front part of the movable furniture part and the stationary furniture part when the movable furniture part is in a closed position with respect to the stationary furniture part. One major aspect of the invention is that the closing gap is adjusted in an activated, electronically assisted, adjusting mode.

In the past, it has been possible to cope with circumstances, such as component or fitting tolerances which affect the respective closing gap, by means, for example, of elements whose position can be varied manually, in particular by movement of parts which act as mechanical fixed-stop surfaces, for example stops or adjusting screws and the like. This procedure is comparatively complex and leads to the closing gap setting accuracy being only very limited. Furthermore, because of the multiplicity of different models in the furniture range, a specific solution in order to readjust the closing gap must in each case frequently be found for different models.

In contrast, according to the invention, a closing gap can be adjusted exactly, effectively, conveniently, and without tools. In particular, there is no need for appropriately qualified personnel or a trade craft procedure for this purpose. In addition, different adjusting parameters can be predetermined flexibly and exactly by means of an electronically assisted adjusting mode. In particular, a closing gap can be increased or decreased in size in considerably finer steps and, if required, can also be reset again. A higher degree of reproduceability of adjustment processes can also be provided by electronic means.

According to the invention, a closing gap or front gap which is set as standard when the closing gap is formed on the front face of a furniture part, for example in the case of drawers, can also be adjusted in parallel without any problems, for example for matching to adjacent fittings or for tolerance compensation or in the case of higher, relatively unstable front structures, when necessary. By way of example, in the case of drawers, a closing gap which is preset as standard to about 2 to 4 millimeters can also be reduced, preferably without undershooting a minimum gap width, however, or in particular can be enlarged. A closing gap size which is the minimum necessary can be observed in particular for example by providing a touch-latch function for the movable furniture part or if the movable furniture part must have a closing gap for an initiation command when the movable furniture part has to be moved in the direction of the stationary furniture part in order to release it, with the closing gap size briefly being reduced. This is because reliable release throughout their life must be ensured in particular for this purpose, by means of an appropriate value of the closing gap. It is therefore frequently possible only to increase a preset closing gap.

Advantageously, in the activated adjusting mode, the closing gap is adjusted by a sequence, which is preferably defined by an operator, of opening and/or closing movements of the movable furniture part. In particular, this allows the closing gap to be adjusted even by non-specialist personnel. In this case, in particular, a sequence of opening and closing movements of the movable furniture part is carried out, with this also being understood as meaning initiation of the opening or closing movement and/or the actual movement of the furniture part under consideration not necessarily having to be carried out. If an opening or closing movement is carried out, then this can be at least assisted by the drive unit for the movable furniture part, thus increasing the operator-friendliness, particularly when furniture parts with relatively heavy loads are being moved.

For the purposes of the invention, the expression "the monitoring unit" can be understood to mean, for example, a regulation or control unit, in particular a computation or computer unit, which in particular comprises a component for monitoring the movement of a plurality of movable furniture parts and which may be responsible for all the relevant movable furniture parts, and/or in each case monitors them. Alternatively or additionally, the monitoring unit may have a plurality of subunits which communicate with one another and are responsible for monitoring the movement of a plurality of movable furniture parts, with one subunit monitoring at least one of the movable furniture parts.

It is particularly advantageous for an additional element (e.g., a computer) to be connected to the monitoring unit for the work in the adjusting mode. An additional element thus allows an adjusting mode to be set up and left again safely, while on the other hand making it possible to avoid accidental or inadvertent variation of the closing gap, with a high level of probability, since work in the adjusting mode is possible only by means of the additional element.

However, this does not preclude the possibility of the additional element being integrated in the monitoring unit, and in particular an adjusting mode or a program and/or appropriate means can be provided in the monitoring unit which can be activated for the work in the adjusting mode, and can be deactivated afterwards.

It is also proposed that the adjusting mode be entered by influencing a movable furniture part. This allows the adjusting mode to be activated in a particularly simple manner. Advantageously, no additional or specific devices are required for this purpose.

Preferably, an opening and/or closing movement of the movable furniture part which is produced by the drive unit, and an opening and/or closing movement of the movable furniture part which is carried out manually by the operator and is not assisted by the drive unit are carried out for adjustment of the closing gap. This allows the closing gap to be adjusted in a simple manner and in particular without additional devices. Furthermore, the combination of manual and driven movement makes it possible to virtually preclude accidental mis-adjustment of the closing gap. In addition, the operator need carry out only a small number of actions, and/or normal actions, for this purpose. As a simplification for the operator, the manual and/or the further opening and closing movements of the movable furniture part can be assisted by the drive unit or can be carried out on their own. This, overall, simplifies the process of adjusting the closing gap.

When the movable furniture part is moved manually, it is moved in particular in accordance with the movement paths for the driven movement, for example along guides, along which the driven movement also takes place.

Preferably, in the activated adjusting mode and when the movable furniture part is in the closed position, the movable furniture part is moved from its closed position, following an input command from the operator, by means of the drive unit to a position from which the movable furniture part is manually moved by the operator, without assistance by the drive unit, to a closed position forming the desired closing gap. This makes it possible to minimize the amount of effort which the operator needs to apply to the process which represents the actual adjustment of the closing gap. In this case, it may be advantageous for the closing gap to be adjustable by someone, depending on the desired gap size. For exact adjustment and/or for matching the movable furniture part to adjacent sections, the person may make use of simple aids, for example a straight edge or a spirit level, in order to determine the desired closing gap position.

Advantageously, information about a closed position, which has been reached in the adjusting mode, of the movable furniture part is supplied to the monitoring unit by means of existing position detection means. Advantageously, existing position detection means can be used for the adjustment of the closing gap. This is because position detection means are frequently already provided in devices for moving the movable furniture part relative to the stationary furniture part, by means of which an exact position of the movable furniture part, with the closing gap set up, can be defined without any additional effort, and the corresponding information can be processed further and stored.

It is also advantageous that in order to adjust the closing gap, the information about the closed position, which has been reached in the adjusting mode, of the movable furniture part is stored in the monitoring unit, when the operator issues a final command once the movable furniture part has reached the closed position. This also allows repeated readjustment of a current closing gap in the adjusting mode. The appropriate information is not made available to the monitoring unit by means of a final command until a definitively desired closing gap has been reached. Only then is this information used in such a way that this closing gap is provided for all the subsequent closed positions. It is therefore possible to avoid fine adjustment of a closing gap and excessively complicated tasks in the electronically assisted adjusting mode for the closing gap.

Furthermore, it is preferable that in the case of a piece of furniture the final command is issued by influencing the movable furniture part by pushing and/or pulling within a predeterminable time interval after reaching the closed position. This makes it possible to further simplify the configuration process. This is because, after the desired closed position has been reached and an appropriate closing gap has been formed, the current closing gap configuration can be verified by a single action. By way of example, this therefore allows a certain period of time to pass to assess the current closing gap, retaining the capability to readjust it. In addition, the monitoring unit need not be locked in a waiting state over an excessively long period of time if no final command is issued in the predetermined time period, thus making it possible to limit the complexity of the adjusting mode.

It is also proposed that, in the case of a piece of furniture with a plurality of driven movable furniture parts, the final command for the relevant furniture part is issued when the closed position has been reached by influencing another movable furniture part by pushing and/or pulling. This provides a further option for issuing the final command. For example, it may be advantageous for the exact definition of the closing gap to be transferred for the relevant furniture part itself to be locked in the corresponding position, and for the closing gap therefore not to be changed at this moment, for the final command.

Advantageously, in the activated adjusting mode, a closing gap which has already been set up for the movable furniture part is transferred unchanged in that, after an input command from the operator, the movable furniture part is moved from its closed position by means of the drive unit to a position from which the movable furniture part is moved further by the operator by manually pushing and/or pulling on the relevant furniture part, without assistance by the drive unit. This procedure makes it easier to adjust the closing gap. The expression "closing gap adjustment" that is used should be understood as being equivalent to the expression "depth adjustment".

In particular, time can be saved if a new closing gap need be set only for individual furniture parts or for a small number of furniture parts when there are a plurality of movable furniture parts, with the already existing closing gap being transferred to the others.

One particularly preferred variant of the method according to the invention is distinguished in that, in the activated adjusting mode, a closing gap which has been set for the movable furniture part is changed in that, as a result of an input command by the operator, the relevant movable furniture part is moved from its closed position by the drive unit, one or more times successively through a minimum distance, which is a minimum movement which can be produced by the drive unit, in the opening or closing direction, and the correspondingly reached new closing gap is stored in the monitoring unit as soon as the operator issues a final command. This allows the closing gap to be varied through a minimum movement distance which can be produced in a driven manner, without manual intervention. In this case, it is advantageously possible to make use of the fact that the drive unit can generally move the movable furniture part in a driven manner through defined or comparatively minimal distances in one direction or in the opposite direction. It is virtually impossible to move through this minimum distance reproduceably when this is done manually or by a person. Furthermore, this driven step-by-step minimum adjustment movement can be used in both directions. If a drive effect on a movable furniture part is provided via, for example, two drive transmission elements, for example on the right and left of a relatively wide furniture drawer, it may be possible to provide a forward movement via a drive transmission element on one side of the drawer and a drive movement in the opposite direction by means of the other drive transmission element on the other side, in each case through a minimal distance or a distance which is only short, thus allowing the drawer to be adjusted parallel to a stationary furniture part, in addition to defining the closing gap.

The invention also relates to a device for moving a movable furniture part relative to a stationary furniture part by means of a drive unit, by means of which the furniture part can be driven to move relative to the stationary furniture part via a monitoring unit for monitoring the movement of the movable furniture part, in which case a closing gap can be formed between a front part of the movable furniture part and the stationary furniture part when the movable furniture part is in a closed position with respect to the stationary furniture part. One major aspect of the invention is that the monitoring unit is designed to adjust a closing gap in an activated, electronically assisted adjusting mode. This means that the advantages already discussed above with regard to the method according to the invention can also be achieved for a corresponding device by means of which the closing gap can be adjusted with electronic assistance in the adjusting mode.

It is also preferable that, in the activated adjusting mode, the closing gap can be adjusted by a sequence which is preferably defined by an operator, of opening and/or closing movements of the movable furniture part.

In one advantageous embodiment of the invention, the monitoring unit is designed to make a connection to an additional element for the work in the adjusting mode. In particular in order to ensure that the adjusting mode is accessed safely and the adjusting mode is left safely, it is advantageous if the monitoring unit can set up a connection to the additional element, in which case the additional element can also be integrated in the monitoring unit. The connection may be set up permanently or else only for the purpose of the adjusting mode. In particular, in addition to a PC or a laptop, it is possible to use an element which is not a computer as an additional element, for example a so-called dongle. In particular, this has the advantage that, in order to work with the dongle, a person does not need to have any specific knowledge which, in contrast, is required when working with a laptop.

It is particularly preferable that the monitoring unit is designed to work with a stored program and/or logic in the activated adjusting mode, in order to adjust the closing gap. This makes it possible to design a program created specifically for the adjusting mode for adjusting the closing gap, thus simplifying the adjusting mode and in this way allowing this to be specifically matched to different applications if required, for example to be matched for linear-movement systems or pivoting systems.

Defined and/or different adjusting modes can also be stored in the drive unit, which can be accessed selectively and can be activated and/or deactivated for the adjusting mode. This allows different adjusting modes to be used if required.

The monitoring unit is preferably designed to obtain information relating to an adjustment process during adjustment of the closing gap via operator output means which are provided in particular in the additional element. This allows work to be carried out effectively and quickly in the adjusting mode. For example, an activated or deactivated configuration mode can be indicated by an appropriate audible signal.

For example, an activated adjusting mode can be indicated via the additional element, by means of a first audible signal. If the front gap is now being configured, that is to say for example a movable furniture part is being opened from a closed position by a drive, the audible signal changes such that a person knows that work is now being carried out in the adjusting mode. After the process of adjusting the closing gap has been completed, possibly with a series of individual steps being carried out, that is to say for example after a final command or an "enter" command, this can once again be indicated by a further change in the audible signal. For example, the signal may be a beeping tone, interrupted at short intervals, or a beeping tone interrupted at long intervals.

By way of example, an activated or deactivated configuration mode can be indicated by the beeping tone interrupted at long intervals, and work in the configuration mode can be indicated by the beeping tone interrupted at short intervals.

In principle, it is also possible to provide visual, tactile and/or audible signals for outputting information to an operator.

The monitoring unit is advantageously designed to move the relevant movable furniture part from its closed position to a parked position by means of the drive unit after an input command from the operator in the activated adjusting mode, and to process information about a movement, which will subsequently be carried out manually by the operator without assistance by the drive unit, of the movable furniture part from the parked position to a closed position, with the desired closing gap being formed. This allows someone to adjust a closing gap as desired in an uncomplicated manner and with a few actions, with the new closed position being set by that person himself, thus allowing him to assess it directly, and if appropriate to readjust it.

It is also preferred that the monitoring unit is designed to store in the monitoring unit information about the closed position, which has been reached in the adjusting mode, of the movable furniture part for the adjustment of the closing gap, when the operator issues a final command after the closed position has been reached.

In a further advantageous embodiment of the subject matter of the invention, the monitoring unit is designed to store the information about the closed position, which has been reached in the adjusting mode, of the movable furniture part in this way, when the final command is issued by influencing the movable furniture part by pushing and/or pulling within a predetermined time interval after the closed position has been reached. This allows the advantages which have already been discussed above to be achieved for the device according to the invention.

It is also preferable that the monitoring unit is designed to carry out the adjustment of the closing gap successively for a plurality of movable furniture parts when in the activated adjusting mode. This also allows a procedure making effective use of time to be carried out for a plurality of movable furniture parts, allowing the advantages mentioned above to be achieved in this case.

It is also advantageous that the monitoring unit is designed to transfer an adjusted closing gap for the movable furniture part unchanged in the activated adjusting mode in this way when, after the relevant movable furniture part has been moved by the drive unit to a parked position, the movable furniture part is moved further by influencing the relevant furniture part by manual pulling and/or pushing, without assistance by the drive unit. This allows a closing gap that has already been set to be transferred in a simple manner as well, if there is no intention of changing it. In principle, a closing gap that has been set can be transferred in such a way that, following the driven movement, a person acts on the relevant furniture part in such a way that a movement takes place in the opposite direction to the previously driven movement direction and/or whose amplitude is considerably greater than that for closing gap adjustment.

Finally, it is proposed that the monitoring unit is designed to vary an adjusted closing gap for the movable furniture part in the activated adjusting mode, and the monitoring unit is designed to move the relevant movable furniture part, after an input command from the operator, one or more times successively by means of the drive unit through a minimum distance, which is the minimum movement which can be produced by the drive unit, in the opening or closing direction and to store the correspondingly reached new closing gap in the monitoring unit as soon as the operator issues a final command.

The invention also relates to a piece of furniture having one of the devices mentioned above. This allows the advantages achieved in this case by the device and the corresponding method to be achieved for the corresponding piece of furniture as well.

BRIEF DESCRIPTION OF THE DRAWING

A highly schematically illustrated exemplary embodiment of the invention will be described in more detail, indicating further advantages and details, and is illustrated in the single FIGURE.

DETAILED DESCRIPTION OF THE INVENTION

Figure 1:
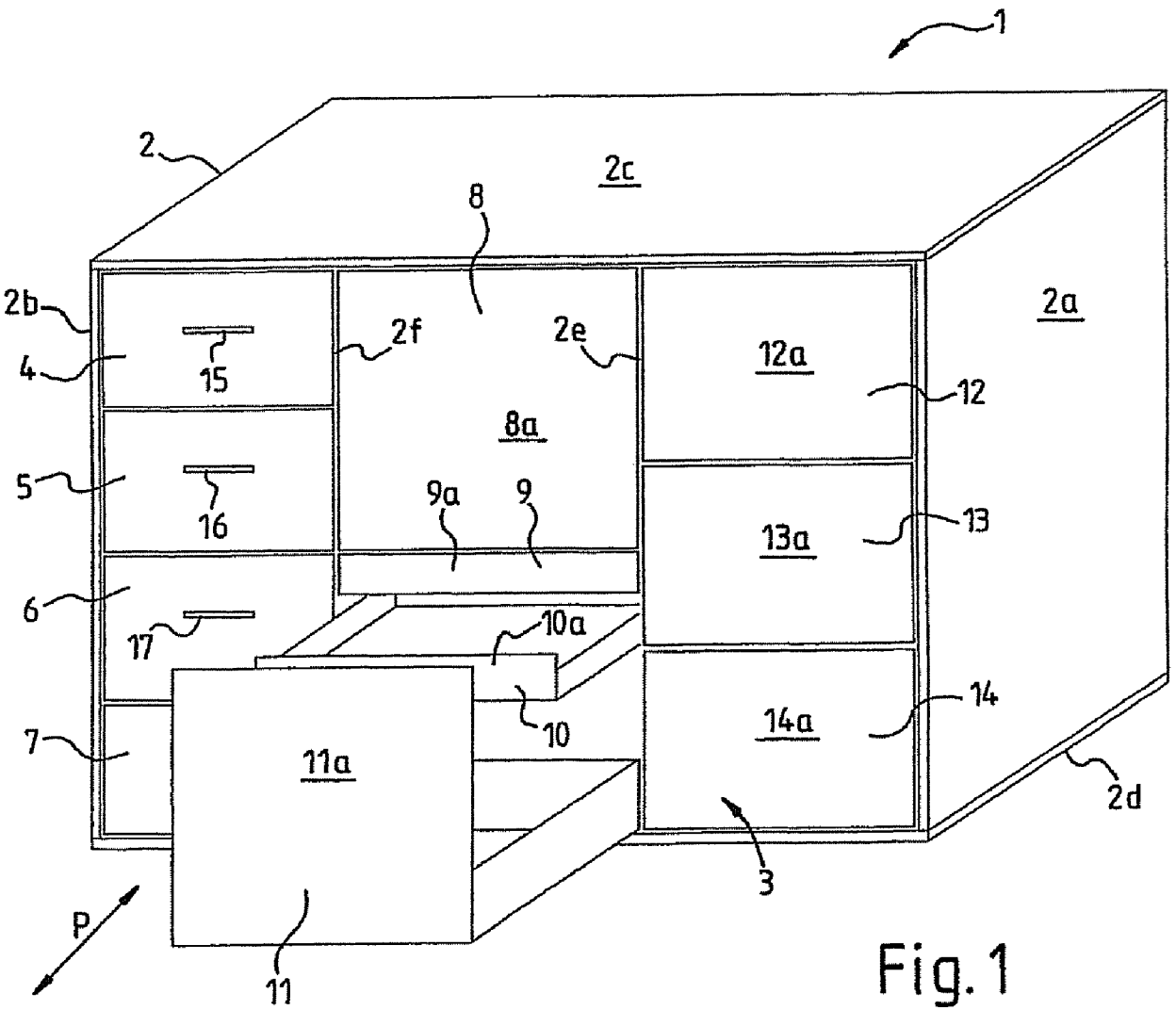
FIG. 1 shows a piece of furniture, illustrated schematically, in the form of a perspective front view, obliquely from above.

FIG. 1 shows a piece of furniture 1 with a stationary furniture part or a furniture housing 2 and furniture drawer units 3, which are guided such that they can move thereon and have a plurality of drawers 4-14. The front part 11*a* of an outer drawer 11 can cover the front part 9*a* of an inner drawer 9 and the front part 10*a* of an inner drawer 10. When the furniture drawer unit 3 is in the closed state, the piece of furniture 1 has a cuboid shape. The furniture housing 2 comprises two outer side walls 2*a* and 2*b*, an upper part 2*c*, a bottom part 2*d* and, in addition, a rear wall (not shown in FIG. 1). The furniture housing 2 also has inner walls 2*e* and 2*f* which run parallel to the side walls 2*a*, 2*b* in the interior of the furniture housing.

The furniture drawer units 3 are held on the side walls 2*a*, 2*b* and the inner walls 2*e*, 2*f* via pull-out guides (not shown) such that they can be moved in the furniture housing 2, for example via known full drawer extensions. The furniture drawer units 3 can be pushed in and pulled out relative to the furniture housing 2 as indicated by the double-headed arrow P. The drawers 4-9 and 12-14 are each located in a closed position, while in contrast the inner drawer 10 is shown approximately half open, and the outer drawer 11 entirely open, with respect to the furniture housing 2.

The front face of the piece of furniture 1 with front parts of the furniture drawer units 3 represents a working face for operating, and/or loading and unloading, of the drawers by a person.

Looking at the piece of furniture 1 shown in FIG. 1 from the front, the arrangement of the drawers comprises three columns, each with a plurality of drawers positioned one above the other. The left-hand column seen from the front comprises the identical drawers 4-7 between the side wall 2*b* and the inner wall 2*f*, and the center column between the inner walls 2*e* and 2*f* comprises the drawers 8-11, while the right-hand column between the inner wall 2*e* and the side wall 2*a* comprises the drawers 12-14.

For driven movement in particular of each furniture drawer unit 4-14 relative to the furniture housing 2, a device (now shown) is provided for example corresponding to one of the devices as explained in WO 2006/029 894 A1, in order to influence the movement of the furniture drawer units 3, with the driven movement being carried out by means of a drive unit and/or a monitoring unit for monitoring the movement of the furniture drawer units 3. FIG. 1 likewise omits connecting lines or the like for supplying the device in order to influence movement.

The fronts of the drawers 4-6 are each provided with a handle element 15-17 and the drawer 7 is provided with a further handle element, which cannot be seen, in order to manually grip the relevant drawer, and in particular in order to pull on the drawer. In principle, it is therefore possible for the drawers 4-7 to be moved just by manual operation, rather than being driven by the drive unit. It is also feasible for the drawers 4-7 to be driven and to be moved manually in order, for example, for their movement when carried out manually by a person to be assisted by the drive unit, in particular during opening.

In particular, the other drawers can be moved by the drive unit, in which case it is feasible for a drawer which can be moved by a drive to be moved manually with or without assistance by the drive unit. For example, the drawers 4-7 can be pulled open manually by using the handle elements, with the drive unit in particular applying a drive effect in order to assist the user. The drive unit may be in many forms and may operate with electrical means, for example with the aid of an electric motor, or nonelectrically by using mechanical means, or may operate with a combination of these means. The opening and/or closing movement can be entirely or partially driven, for example when ejection means are provided for ejection of the movable furniture part from a closed position to an at least partially open position.

On their front parts 8*a*-14*a*, the drawers 8 to 14 are equipped without a contour or without a handle element, or some other aid for pulling on the relevant furniture part. The drawers 4-14 may be provided with or without, for example in particular, ejector or touch-latch functionality. The drawers 8-14 can, for example, be released, and/or opened or closed, by tapping on the front face of a drawer.

For the illustrated drawers, particularly when a touch-latch functionality is provided, a closing gap is formed between an inner face of the drawer front and sections of the furniture housing 2 in the closed state with respect to the furniture housing 2. The closing gap or front gap is generally adjusted at the installation location, for example in order to make any fronts which may possibly be inclined parallel, and in order to compensate for tolerances.

The procedure explained in the following text can be used to adjust a closing gap or front gap of a drawer. An additional element (e.g., a computer) is preferably used for this purpose and, for example for configuration, is attached to the piece of furniture 1 or to the device, which is not illustrated, for influencing movement, and is connected to the monitoring unit. The closing gap is adjusted in an activated adjusting or configuration mode. After activation, which can be carried out for example by means of a switch on the additional element, the activated configuration mode can, for example, be indicated by beeping tones which, for example, beep in an interrupted manner at comparatively long intervals of, for example, two seconds. If a drawer has had to be removed from the furniture housing in order to activate the configuration mode, it must hooked in again for the further configuration and moved to the closed position. A drawer in the closed position which, for example, is provided without a handle element or with a touch-latch functionality and whose closing gap must be changed, or reduced or enlarged, with respect to a given or standard setting, is then tapped and is pushed in somewhat in the direction of the furniture housing. This briefly reduces the existing closing gap, and an initiation command is issued in order to open the relevant drawer. The drawer which has been initiated in this way moves in a driven manner through a short predetermined distance of, for example, about 5 cm forwards. An additional element which is connected to the monitoring unit now beeps in a different rhythm, for example interrupted at short intervals of, for example, 0.5 seconds. In the next step, the drawer which is somewhat open is pushed in manually without assistance from the drive unit, for example with the motor switched off, until it reaches a closed position, forming the desired closing gap. This can be done, for example, by means of a straight edge or the like in order to simplify the definition of the precise position, in order for example to achieve aligned matching with a section of an adjacent drawer that is used as a reference surface. By way of example, this therefore allows the relevant drawer to be matched to an adjacent closed drawer, which projects somewhat further in the closed state than the relevant drawer when in the closed state. If the adjacent drawer projects to a lesser extent than the relevant drawer, this results in a reduction in the existing closing gap. The newly found closed position and therefore the associated closing gap must now be transferred and stored. This can be done in particular by influencing the relevant drawer itself, for example by operating this from the outside within a time window and/or by acting on it, for example by pushing on the front, which corresponds to an "enter" command. The completed adjustment for the relevant drawer is now indicated audibly by a beeping tone, in particular by the additional element, for example by beeping slowly again or interrupted at long intervals of, for example, two seconds.

The "enter" command can be produced within a time window of, for example, 10 seconds, calculated from the time when the closing gap position is actually reached or the newly found closed position, such that the front which has just been adjusted is pushed from the current position to the inner stop or at least from the touch-latch works setting to the inner stop. If no "enter" command is in contrast produced within the time window, the additional element automatically changes to the slow beeping tone again.

Further closing and front gaps can now be set up in a corresponding manner and/or by repeating the steps mentioned above.

If, after the initiation command for opening a relevant drawer, the drawer which has been initiated in this way is extended, driven through the short predetermined distance but instead of the pressure as described above on a drawer front is pulled, this means that the existing closing gap setting for this drawer is not reconfigured, and remains programmed, unchanged as previously. The drawer can now be pulled to the outer end stop or to the open position without power being applied, and the drawer can then be driven by pushing against the front to the closed position, with the most recently programmed closing gap.

This procedure corresponds to a type of "escape" command and makes it possible if required to remove a drawer which is located in front of the additional unit and to switch the additional unit over in order to leave the configuration mode. A check of the most recently set closing gap is therefore also possible.

Closing gaps for inner drawers can also be adjusted in this way. The "escape" command can be implemented by pulling on the outer drawer, in which case the inner drawer units can be adjusted successively after this "escape" command.

A front gap adjustment process can be carried out with the additional unit, for example after completion of a configuration mode for a basic setting or in the kitchen area of a kitchen configuration, such that a switch or control element on the additional unit is used to switch to a further configuration mode, for example "front gap adjustment". The movable furniture part which is intended to be adjusted is then acted on for example by tapping. In consequence, the movable furniture part is moved from a completely closed position, pulse by pulse, in the opening direction. The movable furniture part can start from a closed position, possibly without a front gap being provided, and is moved from a position against an inner stop through at least one drive pulse or through a driven minimum distance which can be moved through, in the opening direction. On reaching the desired position, the front gap setting that has been reached is confirmed by tapping the movable furniture part once again, and the front gap configuration process is complete.

In order to increase the closing gap of a drawer in comparison to a standard setting, a solution that is somewhat less elegant provides that, after activation of the configuration mode, the drawer is driven, for example by tapping, to a position on an inner end stop and is moved from there by a pulse further out than was the case with the previous closing gap setting. If the newly reached closing gap which has been increased by a pulse or a corresponding distance is sufficiently large, it is possible to act on any other desired drawer and to operate it from the outside by pushing, by which means the new closing gap is transferred and stored. If the closing gap is still not sufficient, the relevant drawer is tapped once again, and the drawer is driven forwards, or moved in the opening direction, by a further pulse. This procedure can be continued until the desired closing gap is reached. On reaching the desired closing gap, the configuration mode is ended, for example automatically by a preset time elapsing or by operation of the switch on the additional unit or some other control element.

Various refinements are feasible as an additional unit. The additional unit can be permanently integrated in the device for influencing movement, or else can be connected to it only at times. The additional unit may, for example, be fitted to the apparatus and removed again in a simple action, for example by plugging in and pulling off. The additional unit may comprise a separate part, for example a small computer or large computer, a laptop, a PDA, a network structure, a chip element or the like, or may be integrated in the apparatus and/or the monitoring unit. Input and/or output means may be provided on the additional element, for example a keypad or at least one switch.

The additional unit may also be in the form of an electronic switch or a so-called dongle, for example in the form of an electronic key. By way of example, the dongle can signal a bus master that the configuration is being carried out. An additional element or dongle can also be delivered for each furniture unit or for a group of pieces of furniture that are delivered, for example for a kitchen with corresponding furniture in order in particular to allow the general, and in particular also, the closing gap configuration. By way of example, the dongle may be plugged in on a free outlet of horizontal wiring. This allows the configuration to be carried out without any problems even by unskilled persons.

In order to prepare for the configuration, the dongle may in particular have a "configuration" switch position, which can be selected by someone. For this purpose, the dongle just has to be plugged on to a plug-in slot, for example of a drawer system. After waiting until a brief enable tone sounds, the dongle will have reached readiness. The system identification is then carried out and can last, for example, up to about 1 minute. The configuration process in the adjusting mode is started only after a continuously repeated signal tone.

Resetting the basic settings or a "reset" function can be achieved by resetting the dongle to emergency operation. Alternatively, a switch on the dongle can be set to emergency operation. For this purpose, the dongle is plugged on to a free outlet on the piece of furniture or the device for influencing movement and an appropriate signal sounds for confirmation. The process now waits until a continuously repeated signal sounds, after which the dongle can be removed. This procedure recreates a basic setting.

For optional front gap adjustment with the dongle, a front view can be set up in which all the relevant fronts of the movable furniture parts or drawers are the same and/or are aligned with one another. For example, a corresponding drawer is tapped with the dongle plugged on, and the system or the monitoring unit adds one pulse to the preset basic setting or a touch-latch position. The drawer moves to a new touch-latch position, which has a new front-gap size.

The exemplary embodiment shown in FIG. 1 illustrates a piece of furniture with a plurality of drawers. However, the invention also relates to other pieces of furniture with driven movable furniture parts such as doors, hatches, tablar panels, wire baskets, medicine cabinets, rotating doors or frames, carousels or the like.

LIST OF REFERENCE SYMBOLS

1 Piece of furniture
2 Furniture housing
2*a* Side wall
2*b* Side wall
2*c* Upper part
2*d* Bottom part
2*e* Inner wall
2*f* Inner wall
3 Furniture drawer units
4 Drawer
5 Drawer
6 Drawer
7 Drawer
8 Drawer
8*a* Front part
9 Inner drawer
9*a* Front part
10 Inner drawer
10*a* Front part
11 Outer drawer
11*a* Front part
12 Drawer
12*a* Front part
13 Drawer
13*a* Front part
14 Drawer
14*a* Front part
15 Handle element
16 Handle element
17 Handle element

We claim:

1. A method for adjusting a closing gap in a piece of furniture that comprises a device for moving a movable furniture part relative to a stationary furniture part by means of a drive unit, and a monitoring unit for monitoring the movement of the movable furniture part, said method comprising forming a closing gap between part of the movable furniture part and the stationary furniture part when the movable furniture part is in a closed position with respect to the stationary furniture part, and adjusting the closing gap in an activated, electronically assisted, adjusting mode.

2. The method as claimed in claim 1, wherein the closing gap is adjusted by a sequence of opening and/or closing movements of the movable furniture part.

3. The method as claimed in claim 1, further comprising connecting an additional element to the monitoring unit to assist in the performing the adjusting mode.

4. The method as claimed in claim 1, wherein the adjusting mode is initiated by moving the movable furniture part.

5. The method as claimed in claim 1, wherein the closing gap is adjusted by an opening and/or closing movement of the movable furniture part which is produced by the drive unit, and an opening and/or closing movement of the movable furniture part which is carried out manually by an operator and is not assisted by the drive unit.

6. The method as claimed in claim 1, wherein, in the activated adjusting mode and when the movable furniture part is in the closed position, the movable furniture part is moved from the closed position, following an input command from an operator, by means of the drive unit to a position from which the movable furniture part is manually moved by the operator, without assistance by the drive unit, to a closed position forming the desired closing gap.

7. The method as claimed in claim 1, wherein information about the closed position is supplied to the monitoring unit by means of an existing position detector.

8. The method as claimed in claim 1, wherein information about the closed position is stored in the monitoring unit when an operator issues a final command once the movable furniture part has reached the closed position.

9. The method as claimed in claim 8, wherein the final command is issued by the operator pushing and/or pulling the movable furniture part within a predetermined time interval after reaching the closed position.

10. The method as claimed in claim 8, wherein the piece of furniture has a plurality of driven movable furniture parts, and the final command for one movable furniture part is issued when its closed position has been reached and when another movable furniture part is moved by pushing and/or pulling.

11. The method as claimed in claim 1, wherein during the activated adjusting mode, a closing gap which has already been set up for the movable furniture part is transferred unchanged in that, after an input command from an operator, the movable furniture part is moved from its closed position by means of the drive unit to a position from which the movable furniture part is moved further by the operator by manually pushing and/or pulling on the relevant furniture part, without assistance by the drive unit.

12. The method as claimed in claim 1, wherein during the activated adjusting mode, a closing gap which has been set for the movable furniture part is changed in that, as a result of an input command by an operator, the relevant movable furniture part is moved from its closed position by the drive unit, one or more times successively through a minimum distance, which is a minimum movement which can be produced by the drive unit, in the opening or closing direction, and the correspondingly reached new closing gap is stored in the monitoring unit as soon as the operator issues a final command.

13. A device for moving a movable furniture part relative to a stationary furniture part comprising a drive unit to move the movable furniture part relative to the stationary furniture part, and a monitoring unit for monitoring the movement of the movable furniture part, wherein a closing gap is formed between part of the movable furniture part and the stationary furniture part when the movable furniture part is in a closed position with respect to the stationary furniture part, and wherein the monitoring unit adjusts the closing gap in an activated, electronically assisted adjusting mode.

14. The device as claimed in claim 13, wherein the closing gap is adjusted by a sequence of opening and/or closing movements of the movable furniture part.

15. The device as claimed in claim 13, further comprising an additional element connected to the monitoring unit to assist in performing the adjusting mode.

16. The device as claimed in claim 13, wherein the monitoring unit works with a stored program and/or a logic in the activated adjusting mode, in order to adjust the closing gap.

17. The device as claimed in claim 15, wherein the monitoring unit provides information relating to an adjustment process during adjustment of the closing gap to an operator via output means which are provided in the additional element.

18. The device as claimed in claim 13, wherein the monitoring unit moves the movable furniture part from its closed position to a parked position by means of the drive unit after an input command from an operator in the activated adjusting mode, and processes information about a movement, which will subsequently be carried out manually by the operator without assistance from the drive unit, of the movable furniture part from the parked position to a closed position, with the desired closing gap being formed.

19. The apparatus as claimed in claim 13, wherein the monitoring unit stores information about the closed position, which has been reached in the adjusting mode, of the movable furniture part for the adjustment of the closing gap, when an operator issues a final command after the closed position has been reached.

20. The device as claimed in claim 19, wherein the final command is issued by the operator pushing and/or pulling the movable furniture part within a predetermined time interval after the closed position has been reached.

21. The apparatus as claimed in claim 13, wherein the monitoring unit carries out the adjustment of the closing gap successively for a plurality of movable furniture parts when in the activated adjusting mode.

22. The device as claimed in claim 13, wherein the monitoring unit transfers an adjusted closing gap for the movable furniture part unchanged in the activated adjusting mode when, after the movable furniture part has been moved by the drive unit to a parked position, the movable furniture part is moved further by manual pulling and/or pushing of the movable furniture part, without assistance by the drive unit.

23. The device as claimed in claim 13, wherein the monitoring unit varies an adjusted closing gap for the movable furniture part in the activated adjusting mode, and the monitoring unit is designed to move the movable furniture part, after an input command from an operator, one or more times successively by means of the drive unit through a minimum distance, which is the minimum movement which can be produced by the drive unit, in the opening or closing direction and to store the correspondingly reached new closing gap in the monitoring unit as soon as the operator issues a final command.

24. A piece of furniture comprising the device as claimed in claim 13.

* * * * *